US005407248A

United States Patent [19]

Jay et al.

[11] Patent Number: 5,407,248

[45] Date of Patent: Apr. 18, 1995

[54] DEFORMITY BACK SYSTEM

[76] Inventors: Eric C. Jay, P.O. Box 18656, Boulder, Colo. 80308-8656; John A. Dyer, 11556 W. 102 Place, Westminster, Colo. 80021; John C. Dinsmoor, III, 10055 Hooker St., Westminster, Colo. 80030

[21] Appl. No.: 110,489

[22] Filed: Aug. 23, 1993

Related U.S. Application Data

[63] Continuation of Ser. No. 960,255, Oct. 13, 1992, abandoned, which is a continuation of Ser. No. 658,045, Feb. 20, 1991, abandoned.

[51] Int. Cl.[6] ..... A47C 7/46

[52] U.S. Cl. ..... 297/284.1; 297/284.3; 297/284.9; 297/284.4; 297/440.2; 297/464; 297/DIG. 6

[58] Field of Search ..... 297/284.1, 284.3, 284.4, 297/284.5, 284.7, 284.9, 440.2, 452.29, 452.31, 452.36, 452.37, DIG. 4, DIG. 6, 464; 5/464, 465, 481

[56] References Cited

U.S. PATENT DOCUMENTS

| | | | |
|---|---|---|---|
| 3,424,493 | 1/1969 | Gothfried et al. | 297/464 |
| 3,452,421 | 11/1970 | Ambrose | 297/284 G X |
| 3,495,871 | 2/1970 | Resag et al. | 297/284 R X |
| 4,073,537 | 2/1978 | Hammersburg | 297/DIG. 4 X |
| 4,402,548 | 9/1983 | Mason | 297/464 |
| 4,628,557 | 12/1986 | Murphy | 5/464 X |
| 4,647,066 | 3/1987 | Walton | 297/284 G X |
| 4,706,313 | 11/1987 | Mundy | 297/444 |
| 4,947,500 | 8/1990 | Seiler | 5/464 X |
| 5,018,790 | 5/1991 | Jay | 297/452.25 X |

*Primary Examiner*—Peter R. Brown
*Attorney, Agent, or Firm*—W. Scott Carson

[57] ABSTRACT

A wheelchair back system adapted to provide a customized fit to the user. The system includes a rigid back shell removably affixed to the wheelchair, a plurality of foam blocks, and a pad member containing flowable fluid material. The back shell has a forward facing, front surface and the foam blocks are removably positionable forward of the back shell to form a substantially continuous layer of foam of substantially uniform depth forward of the back shell. Each foam block is individually and separately removable to provide a recessed area in the otherwise continuous layer of foam to provide a customized fit to the user. The pad member overlies the front surface of the foam blocks and is received in any recessed area formed by the removal of a foam block. In this manner, the system can be customized to the deformities or other abnormalities of each individual user.

45 Claims, 11 Drawing Sheets

DEFORMITY BACK SYSTEM

This is a continuation of application Ser. No. 960,255 filed Oct. 13, 1992, now abandoned, which is a continuation of application Ser. No. 658,045, filed Feb. 20, 1991, now abandoned.

BRIEF DESCRIPTION OF THE INVENTION

The present invention relates to a modular back system for use in wheelchairs. More particularly, the modular back system of the present invention includes a mounting means and a rigid back shell which may be fitted with a variety of padding systems.

The mounting means is adapted to attach the rigid back shell to the vertical posts of the wheelchair and to adjust the wheelchair rigid back at a selected position and attitude. That is, the mounting means is adapted to selectively adjust the attitude of the rigid back shell, i.e., adjust the height of the rigid back shell with respect to the seat of the wheelchair, to adjust the angle of recline of the rigid back shell and to adjust the depth of the rigid back shell (the distance forward or rearward from the vertical posts). Importantly, the mounting means is adapted to maintain the selected attitude adjustments of the rigid back shell when the wheelchair back system is removed from the wheelchair for transportation or storage. Thereafter, when the back is reattached to the wheelchair, the back will resume its desired, selected attitude and position and height.

The rigid back shell is a hard, relatively rigid surface extending between the wheelchair's vertical posts to provide mechanical support to the back and extending forward, at its lateral edges with a pair of forwardly extending flanges to provide lateral support. The padding system is generally mounted between the two forwardly extending flanges.

In a first embodiment, the padding system comprises a contoured foam pad attached to the rigid back shell. In the preferred embodiment, a fluid pad member comprising an envelope containing a flowable fluid material is positioned to overlie the spinal region of the user. This embodiment is particularly useful for persons which do not require extensive customization of the wheelchair back.

In a second embodiment, the padding system comprises a thin shim attached to the front side of the rigid back shell. A plurality of thicker foam blocks are removably attached to the front side of said shim by a hook and loop fastening means. The blocks form a substantially continuous layer of foam of substantially uniform depth over the front of the shim. In order to customize the padding system for a person with extreme back deformities, one or more of the foam blocks may be removed from the shim to create a recessed area. The recessed area can be used to accommodate any protrusions from the back of the user. A pad member is placed over the foam blocks, including the recessed area. The preferred embodiment of this pad comprises an envelope containing a flowable fluid material and sized to overlie the front surface of the shim and over the front surface of the foam blocks.

The present invention also contemplates the use of transition wedges which are used to provide a smooth transition from the foam blocks into the recessed areas. The present invention also contemplates the use of build-up pads or blocks which may be attached to the front side of the foam blocks and/or to the front side of the shim in the recessed area to further customize the fit of the wheelchair back for the needs of users. Alternatively, the build-up pads may be attached to the front side of a contoured foam pad, as used in the first embodiment.

The padding systems, including the contoured foam pad and blocks, transition wedges, build-up pads, fluid pad, and thin shim are all preferably covered by a fabric cover, which may be an outside cover only, or may be an outside cover enclosing an inside cover and attached to a rigid back shell by a hook and loop fastening means.

BACKGROUND OF THE INVENTION

A significant number of people confined to wheelchairs have body deformities which require a customized back. These people require a wheelchair back which conforms to the shape of their bodies so that they will have enough contact with the wheelchair back to be able to sit upright, without falling over. A custom shaped back also provides comfort and avoids skin pressure that may result in decubitus ulcers (pressure sores). Decubitus ulcers are a very serious problem that requires hospitalization, surgery, and extensive rehabilitation. It is estimated that the current cost of caring for a decubitus ulcer is in the $60,000 to $75,000 range. Naturally, while the patient is hospitalized, he is unable to travel, work, or enjoy other pleasures afforded by mobility, and tremendous and devastating psychological trauma can occur.

The people requiring customized wheelchair backs include those affected with cerebral palsy, muscular dystrophy, multiple sclerosis, head injuries, and other similar ailments. Their needs for customized backs can develop because of kyphosis, scoliosis, and lordosis, plus a combination of twisted deformities in varying degrees of severity.

In order to fit those people with back deformities properly in a wheelchair, the back of the wheelchair must be contoured so as to be able to fit closely to the body's shape so as to provide support over the whole back without putting too much pressure on any one point. Currently, there are three approaches used to develop such a contoured wheelchair back.

The first approach is a custom foam system. In this system, an impression is taken of the body. Once the impression is made, it is sent to a factory site. At the factory, foam is either carved by hand or molded to match the impression of the body shape. An upholstery cover is placed over the carved or molded foam.

This method suffers from a number of disadvantages. For one, it takes a long time to construct the system (typically several weeks). It is also a labor-intensive method and, therefore, expensive. Further, when completed, the system cannot be changed even if it was done incorrectly. Systems on the average take three to six weeks to deliver and three to six weeks to remake if done improperly. The system also cannot be changed if the user's body changes over a period of time. This is especially a problem with children whose bodies quickly and continually change. It is also not possible to fit the user in his own wheelchair which increases the probability of an improper fit at the time of delivery. Rather, the fitting must be done in a fitting frame. Further, there is no opportunity to assess or evaluate the system's effectiveness by the user prior to purchasing it since the system is custom made. In addition, if the foam or cover wears out, the entire system needs to be replaced. Finally, problems with decubitus ulcers are often encountered because of shearing, improper fit, and the user moving and not sitting in the molded position.

The second common approach is a foam-in-place system. With this system, a flexible plastic bag is put between the user and a rigid surface. Liquid foam is then injected into the bag. The liquid foam expands into a rigid foam which takes the shape of the user's body. This system also has a number of disadvantages including the fact that it is messy, and that one cannot control the volume of the foam. In addition, the foam-in-place system has all of the above disadvantages of the custom carved molded products.

The third system is marketed under the trade name MATRIX. It allows custom fit to the individual by adjusting a series of metal parts that form to virtually any body contour. The hard matrix is then covered by foam and a fabric cover. This system takes an average of 4–8 hours to fit and is very difficult to refit should someone desire to change the system.

The back system of the present invention overcomes the foregoing problems as is more fully described below.

SUMMARY OF THE INVENTION

The present invention relates to a modular wheelchair back system.

The wheelchair system of the present invention comprises a rigid back shell and a mounting means adapted to removably affix the rigid back shell to the vertical posts of a wheelchair at a selected position in a selected attitude. The rigid back shell is fitted with one of several padding systems.

The Mounting Means

The mounting means is preferably a 4 point mounting means adapted to removably attach the modular back to the wheelchair in a selected position and attitude. In its preferred embodiment, the mounting means includes means to adjust (and maintain in the adjusted position) the back in the desired depth and angle mounted on the rigid back shell and the means to adjust and lock the height mounted on the vertical posts of the wheelchair. The mounting means preferably comprises a pair of post brackets, which are mounted on the vertical posts in a selected position, to accommodate the user's needs. A pair of rods, adjustably affixed to the rigid back shell, engage the vertical post brackets. A pair of U brackets, adjustably affixed to said rigid back shell, engage the wheelchair posts at a location spaced apart from said post brackets. The depth and angle of the back is controlled by adjustment of the position of the rods (which engage the post brackets) and adjustment of the position of the U bracket. Using these adjustments, the depth of the back may be adjusted forward or backwards in the chair, and the angle of the back may be adjusted. The selected back position is maintained by the mounting means even after removal from the wheelchair and later replacement on the wheelchair. The mounting means also does not normally interfere with the arm rest or the folding mechanism of the chair. This allows for easy folding of the wheelchair for transportation.

The ability to recess the back is important to lengthen or shorten seat depth for different users, to adjust backward over time to accommodate growth, and to keep feet in footrests. The ability to recline the rigid back shell is important to accommodate a hip angle of more than 90°, to allow users with severe kyphotic deformity to look straight ahead rather than at their lap which results in fatigue to the neck, and to increase stability by allowing the head to rest against a headrest.

These adjustments generally are made one time during fitting, and then do not need to be changed, even when the back system may be removed at a later date to transport it, and is then replaced back in the chair for use. Further, if a change from the initial position is required for example, to accommodate the user's growth, the back may be readjusted in height and forward or backwards in the chair and the angle of the back may also be adjusted and re-set in the new position.

Rigid Back Shell

The rigid back shell includes a monolithic, rigid surface, which is generally contoured with the vertical center line being somewhat to the rear of the lateral edges in a manner to generally conform to the shape of a human back. Attached to the lateral edges are a pair of forwardly extending flanges. The mounting means is attached to the forwardly extending flanges. While whatever type of padding system used is generally mounted within the volume defined by the forward extending flanges.

The Padding System

A first embodiment of the padding system of the present invention relates to contoured backs for wheelchairs for people who do not require extensive customization of the back. More particularly, this embodiment relates to a wheelchair back system comprising a contoured foam pad. In the preferred embodiment a fluid pad member is attached by a hook and loop fastening means such as is commonly available under the tradename VELCRO to overlie the front surface of the contoured foam pad along the length of the spinal region of the user and is attached to the contoured foam pad so that it runs down the middle of the contoured foam pad.

The second embodiment of the padding system of the present invention relates to custom shaped backs for wheelchairs for people confined to a wheelchair and who require an extensively customized wheelchair back. This embodiment comprises removable foam blocks, transition wedges and build-up pads which are attached to a thin shim. The foam blocks provide a substantially continuous layer of foam having a substantially uniform depth of the entire front surface of the shell. Individual blocks can be removed in order to create a padding system surface conforming to the shape of the person's back deformity. The thin shim may be placed in the rigid back shell between the rigid back shell and the foam blocks. Alternatively, build-up pads cam be added to the front surface of the layer of blocks in the second embodiment or to the front surface of a contoured foam pad in the first embodiment to further customize the padding system and can be removed or added to the shim so as to create a padding system surface conforming to the shape of the person's deformed back. In addition, a pad member is attached by VELCRO to the shim, the build-up pads, and the foam blocks. The pad member overlies the front surface of the shim and the foam blocks and build-up pads.

To form a proper contour for the shape of the user's back, the foam blocks can be removed from the shim to form a recessed area to provide a customized fit for the user's back with a possible depth of as much as 4 inches behind the original surface of the blocks. The edges of these blocks are preferably beveled so that they do not present a sharp edge to the person's body and generally do not require modification by the person setting up the system. While the preferred embodiment uses blocks which do not generally require modification by the therapist or person doing the fitting, it is understood that another embodiment could employ blocks which generally may be modified for a substantially perfect fit. Foam transition wedges are provided to achieve a smooth transition from the front plane of the removable blocks to the front surface of the thin shim or rigid back shell. Various size transition wedges allow a more custom fit. Additional conformity to the user's back shape is achieved by filling in spaces or voids in areas forward of the front plane of the removable blocks or the contoured foam pad by placement of build-up pads on the front plane of the removable blocks or contoured foam pad. These build-up pads contour to the body shape in order to fill in around the body. The build-up pads can also be used in the recessed area (where the blocks were removed) to build up that area since removing the blocks may create too much of a recessed area.

Foam lateral supports with optional reinforcing VELCRO suspender may be attached to the front surface of the foam blocks or the contoured foam pad with VELCRO.

The Pad Member

The pad member, which overlies the foam blocks, may be a thin foam pad or a flexible envelope containing a flowable fluid material, adapted to smooth out the contour of the back over the blocks, recessed areas and add-on pads.

In the first embodiment, a fluid pad member generally is used to overlie the spinal region of the user, but may be sized to overlie the entire surface of the padding system.

In the second embodiment, a fluid pad member is used to make the customizable padding system have a substantially perfect contoured fit to the user's back. Further, the pad member allows the person to be able to move a little while still maintaining a substantially perfect contoured fit to his body. The pad member covers the whole front surface of the padding system. It is oversized by a significant amount so that it can be draped into any recesses and easily fill in over the build-ups from the build-up pads while overlying the surface of the thin shim. The pad member will also generally smooth out the edges of all the components (i.e. foam blocks, foam lateral supports, build-up pads, transition wedges) underneath it. The pad member is held in its proper position by having VELCRO on the back side of the pad member, which attaches to the foam blocks, build-up pads and transition wedges and to the thin shim in the recessed area. In addition, the pad member has flaps which fold over the back of the thin shim and attach to the back of the shim by VELCRO. The plastic film of either side of the pad member may be transparent so that the therapist or fitter may observe where the fluid has displaced during the fitting process, and thus adjust the fitting to provide substantially uniform pressure on contact areas of the user's back.

A further reason for the pad member to be oversized is to prevent hammocking. Hammocking is defined as a suspension of the bony prominences of the user on the surface of the padding system, thereby preventing substantial conformity of the padding system to the user's body and preventing substantially complete pressure equalization. By having an oversized pad member, the surface will easily yield in response to pressure from the bony prominences and therefore distribute the pressure over a larger area.

The Cover

The shim, foam blocks, build-up pads, foam lateral supports, and pad member all fit inside the covering system which may be of two embodiments. One embodiment employs an inside protective cover and an outside washable cover. The inside cover is incontinent and protects the whole system from any tampering with the positions of the internal components, while the outside cover may be easily removed for washing. Further, the zipper of the inside cover can be partially unzipped while the user is still sitting against the system so that the therapist can make adjustments to better fit the user's body immediately. This is especially important when there have been changes in the user's body shape, and if the system is not adjusted, a substantially perfect fit will no longer exist, and a decubitus ulcer can quickly form. The inside cover is a full-zip enclosed cover which is attached to the pad member. The inside cover contains VELCRO attachment points. The front of the cover is oversized to avoid a hammocking effect when covering the recesses in the padding system surface. The covering system may have VELCRO points that are attached to VELCRO points on the foam blocks and the thin shim. The outside cover is a removable washable cover and includes extra material so that there is no hammocking effect creating pressure on the user's body. Tear out seams allow for adjustment of the cover shape depending on the deformity, to provide enhanced cosmetic appearance.

A second embodiment of covering is an outside stretch cover, stretching over the front of the foam parts, but leaving the back of the thin shim or contoured foam pad exposed. Either style of covering is intended to provide at least one cover that will protect the internal components.

The Customization

Because the customizable back system of the present invention uses removable foam blocks, transition wedges, build-up pads, and pad member, the system can be quickly set up for a user by a therapist or training fitter. Accordingly, a lot of the labor expense of producing the system that was required in the prior systems is eliminated. Further, a user can have the system the day he is fitted for it. It can even be fit into the user's own wheelchair. Even if a substantially perfect fit is not initially achieved, the components of the system can be easily changed so as to achieve a substantially perfect fit. Also it may be necessary to change the contour later if the person's body changes due to gravity, growth, etc. In addition, because the components of the system can be so easily set-up, the user has an opportunity to assess and evaluate the system prior to purchasing it. Further, if some of the components of the system wear out, they can be replaced without having to have the entire system replaced. Furthermore, because a substantially perfect fit to the user's body can be achieved and because the system can allow for movement by the user, the probability of decubitus ulcers is greatly decreased over that which occurred in the prior systems. Furthermore, this system permits the concept of progressive fitting, meaning the fitter can choose to become more aggressive with successive fittings, thus allowing gradual correction of deformities or postural tendencies, much the same as when a dentist tightens teeth braces as the teeth start to straighten.

External Lateral Supports

Lateral supports attached to the rigid back shell, external to the padding system, may be used to provide side-to-side positioning and support of the user's body. These external lateral supports may be needed instead of or in conjunction with the previously described foam lateral supports to provide more aggressive support to the user if necessary. External lateral supports generally include a rigid bracket, foam pad, optional wedges, and optional lining fluid pad with a cover. The external lateral support fits onto the adjustable rigid back shell with VELCRO for assessment, and with bolts for permanent mounting. The rigid bracket fits between the side guards on the rigid back shell and the padding system, and is curved on one end to allow attachment to the rigid back shell between the rigid back shell and the thin shim. The external lateral support may be moved up and down to determine its proper position for the user before permanent mounting. Side-to-side positioning of the foam pad supporting the user's body is achieved using one or more optional wedges between the rigid bracket and the foam pad. Each wedge may be rotated to provide angular tilt adjustment of the foam pad supporting the user's body. An optional small lining fluid pad may be fitted onto the foam pad for additional body conformity. A cover over the foam pad, wedges, and lining fluid pad protects these components. The external lateral supports provide more aggressive lateral support than the previously described foam lateral supports attached to the padding system.

DETAILED DESCRIPTION OF THE INVENTION

Figure 1:
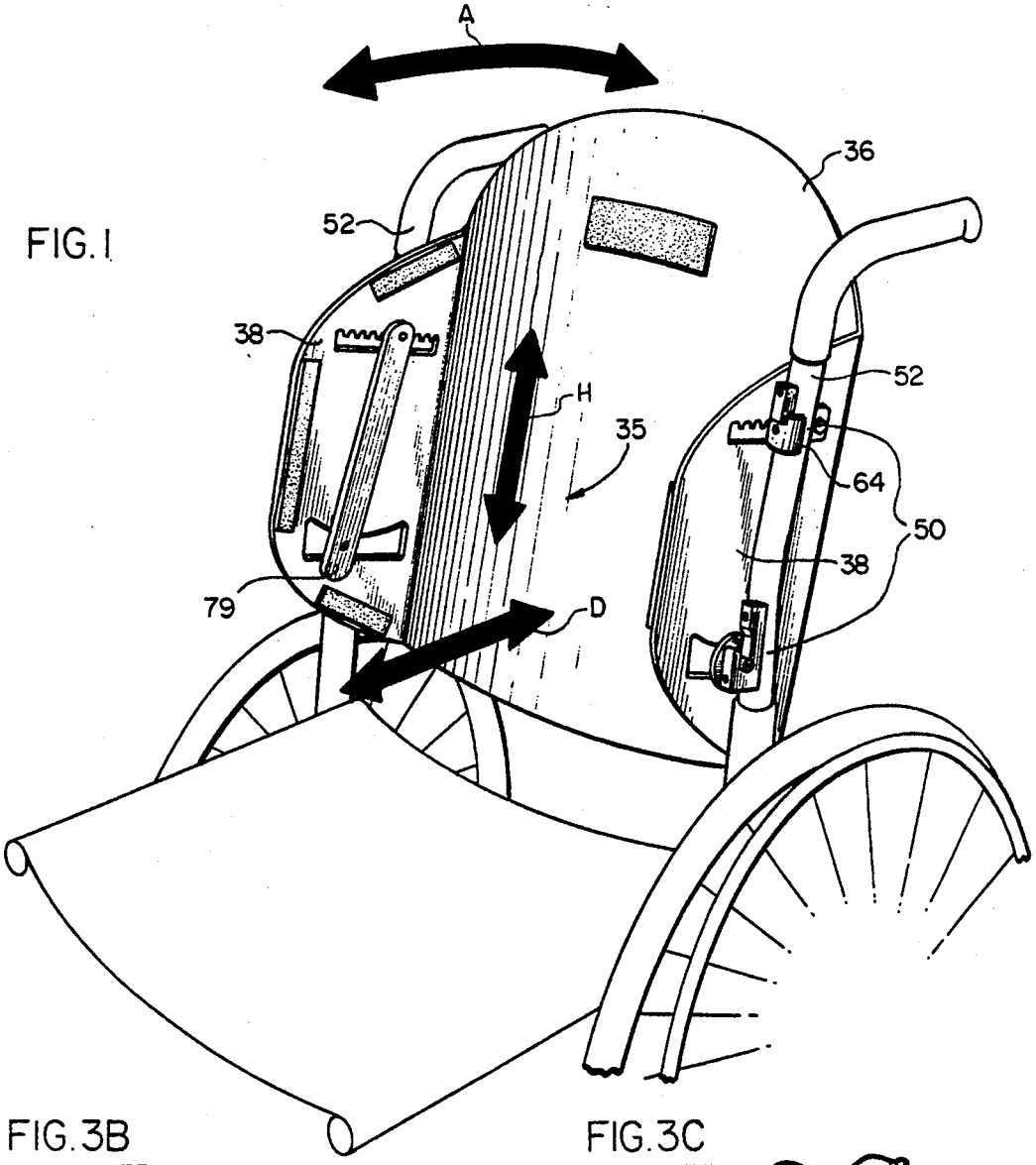
FIG. 1 shows the rigid back shell and the mounting means in a wheelchair.
Figures 2, 3, 3A, 4:
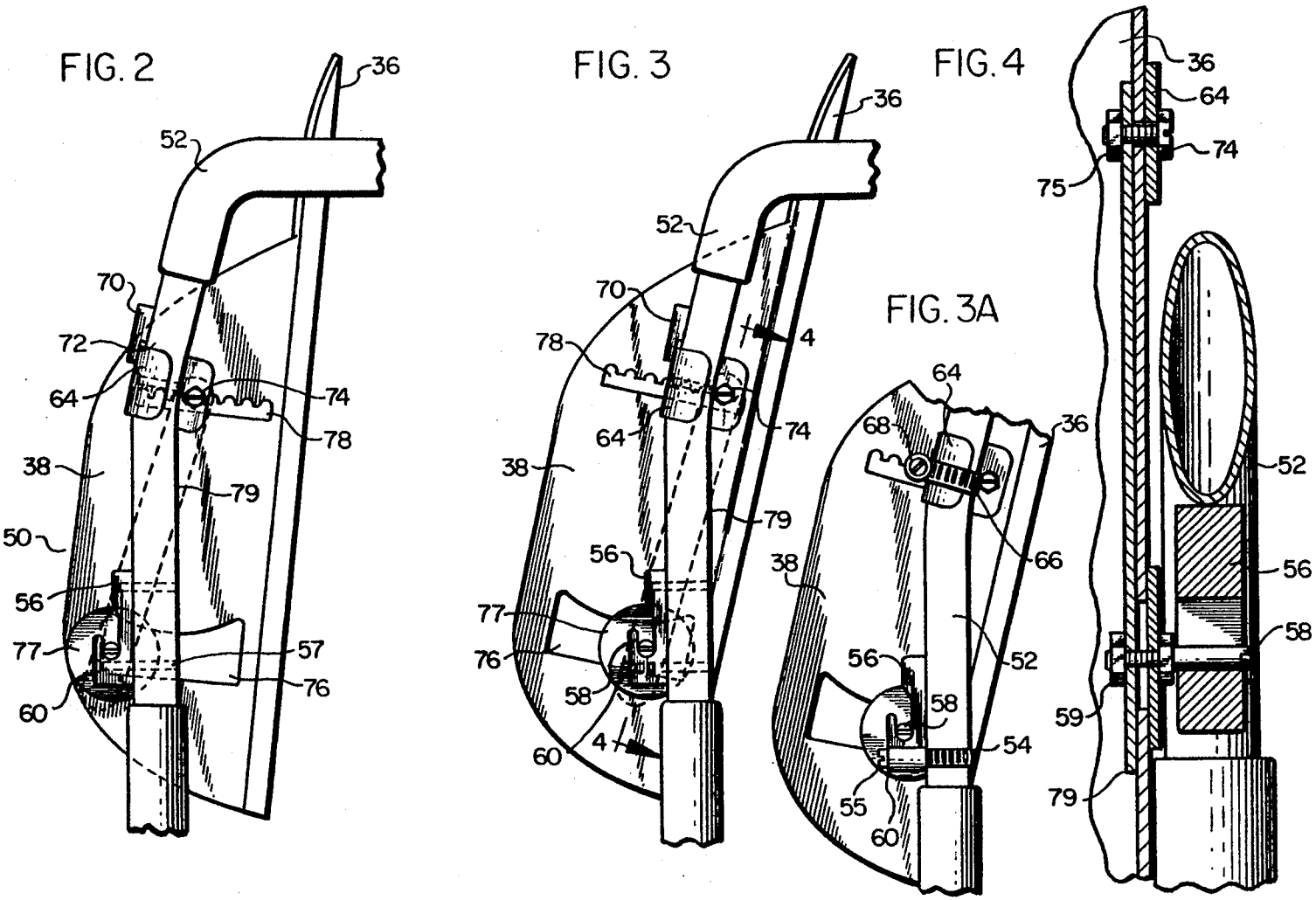
FIGS. 2 and 3 show side views of the mounting means attached to the wheelchair.
FIG. 3A shows a side view of the mounting means using hose clamps for assessment purposes.
FIG. 4 shows a behind view of the mounting means attached to the wheelchair.
Figure 5A:
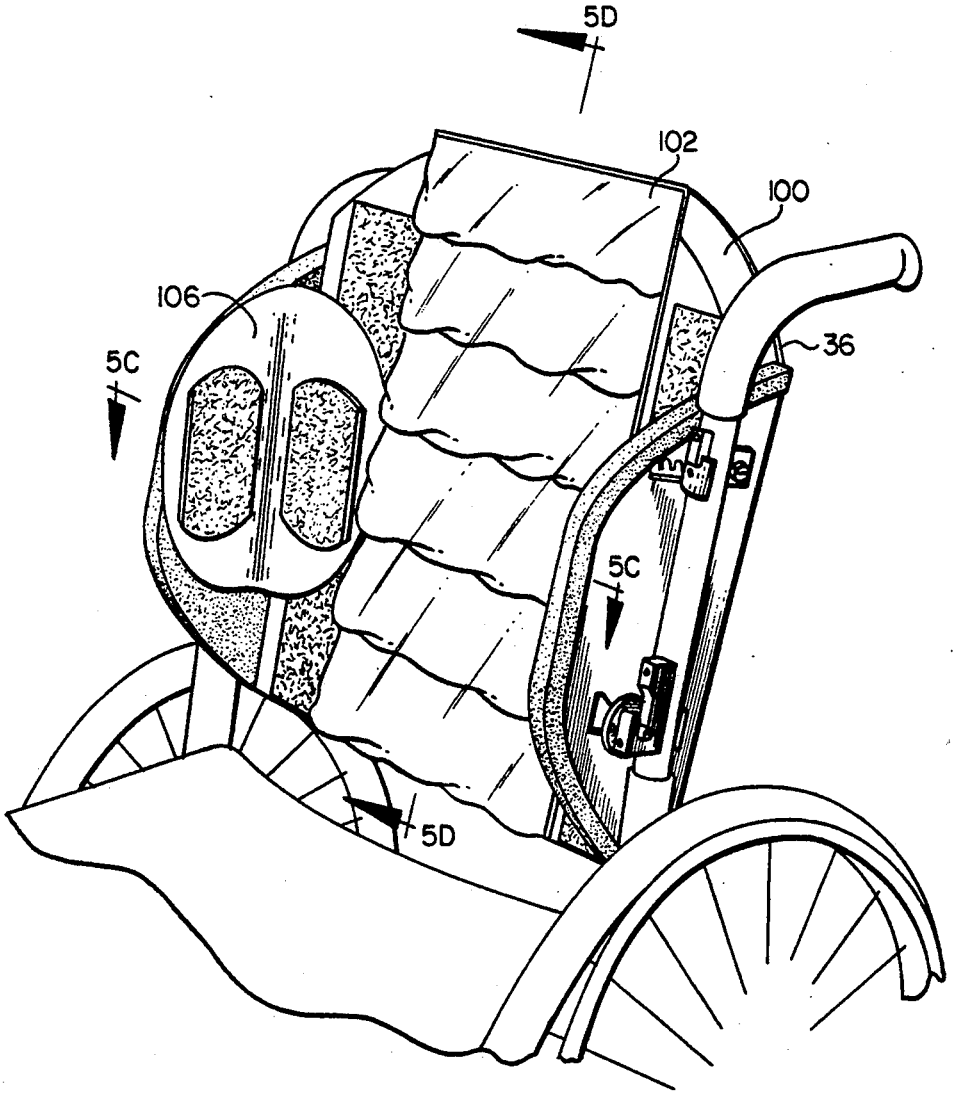
FIG. 5A shows a first embodiment of the padding system in place in a wheelchair.
Figure 5B:
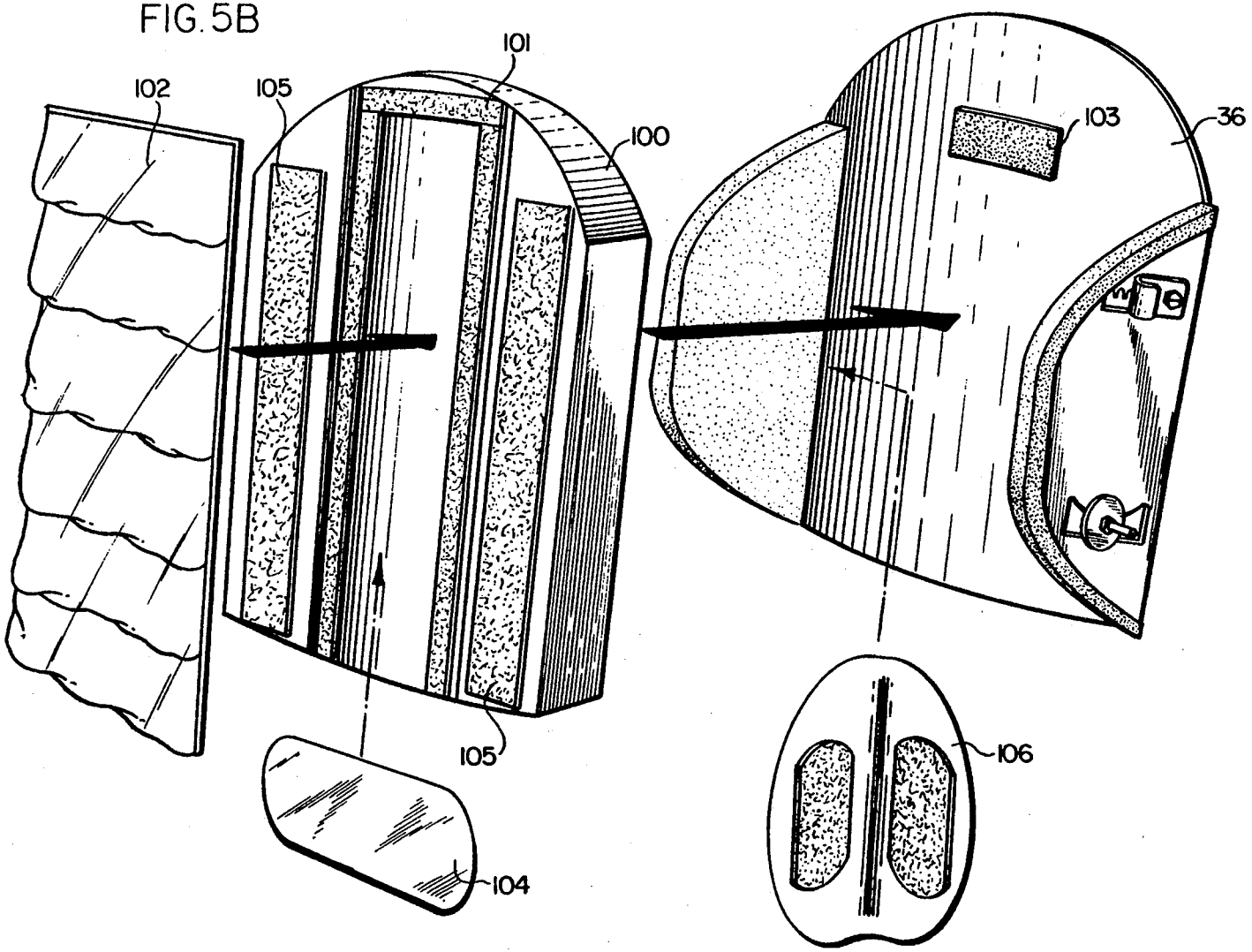
FIG. 5B shows the rigid back shell, foam pad, fluid pad member, adjustable lumber support and trunk supports of the first embodiment.
Figure 5C:
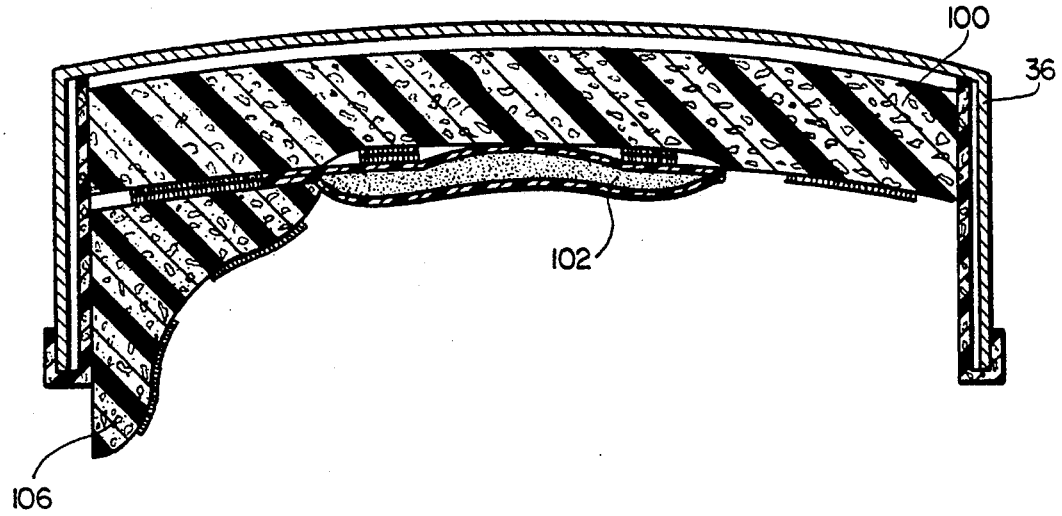
FIGS. 5C and 5D show cross-sectional views of padding system of the first embodiment.
Figure 5D:
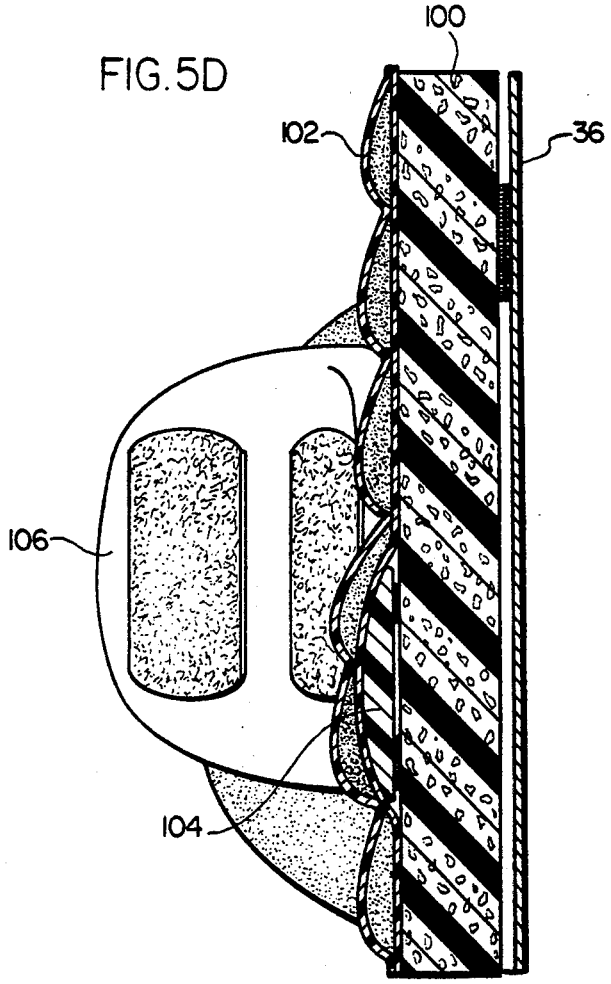

The rigid back shell 36 and mounting means 50 (consisting of post brackets 56, rods 58, screws 57, hose clamps 54, washers 77, U brackets 64, twist retainers 70, hex screws 74, bars 79, and nuts 59, 75, as shown in FIGS. 2, 3, and 4) of the modular back system of the present invention in a wheelchair are generally shown in FIG. 1. The modular back system further comprise a padding system fitted to the rigid back shell.

Rigid back shell 36 is a hard, relatively rigid, relatively inflexible monolithic surface. The rigid back shell 36 extends between the vertical posts 52 of the wheelchair in a generally contoured shape to provide mechanical support for the back system. Attached to the lateral edges of the rigid back shell 36 are a pair of forwardly extending flanges 38. The mounting means 50 is attached to the forwardly extending flanges 38, while the padding system would be generally mounted within the volume defined by the forwardly extending flanges 38 (as generally shown by the arrow 35). The rigid back shell 36 can be made of any rigid material but preferably is made of metal, particularly aluminum. It is to be understood that while the preferred invention uses a monolithic structure, the shell could be constructed of separate components bolted, or otherwise affixed together.

Figure 6:
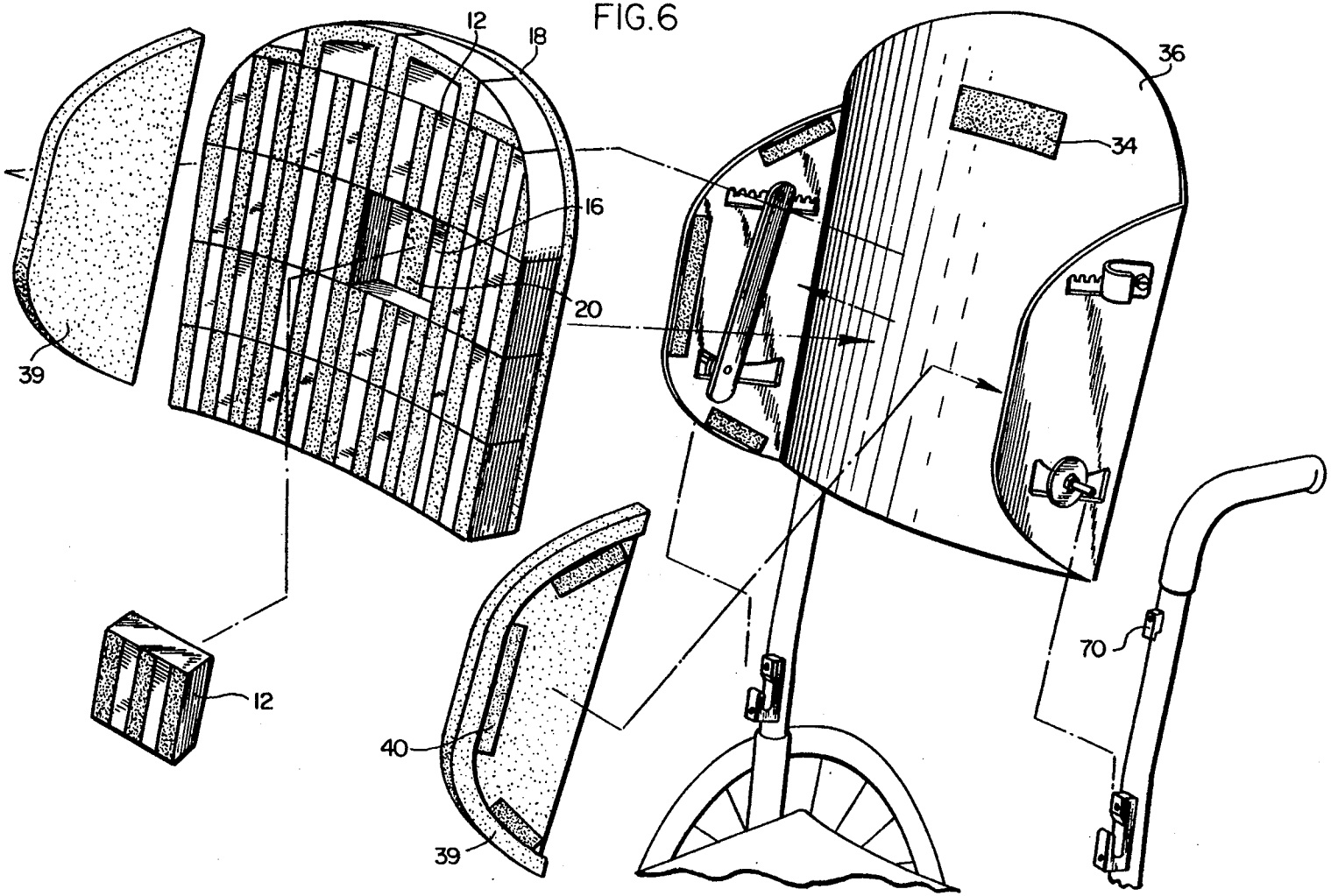
FIG. 6 shows the removable foam blocks in place, the recessed area formed when the blocks are removed, and the attachment of a thin shim to the rigid back shell.

It is to be understood that the configuration of the blocks shown in FIG. 6 is preferred and that the present invention is not to be limited to the geometric configuration of each block, nor is there a requirement that each block be of the same size. The design of the blocks is such to allow the trained therapist to provide recesses at suitable locations customized to the shape of the user's back.

Foam side guards 39 can be placed on the interior of the forwardly extending flanges 38. The foam side guards 39 are preferably attached by VELCRO strips 40. The foam side guards 39 protect the user from being scratched by the mounting means 50.

FIGS. 1-4 show the preferred embodiment of the mounting means 50 used to removably affix the rigid back shell 36 to the wheelchair and, particularly to the vertical posts 52 of the wheelchair. FIGS. 2, 3, and 3A show a side view of the mounting means. This view illustrates the parts used for adjusting the height H, angle A, and depth D of the rigid back shell 36. The rigid back shell 36 can be adjusted to any suitable height H such as from a height of 17 inches high to 22 inches high from the top of the wheelchair's horizontal rails to the top of the rigid back shell. The means for adjusting the height may be mounted on the back shell, but preferably the height adjusting means is mounted on the vertical wheelchair posts 52 as illustrated in the drawings.

A post bracket 56 is affixed to the vertical posts 52. The post bracket 56 is preferably made of aluminum. Post bracket 56 is adapted to engage rod 58 which is adjustably affixed to the rigid shell back 36. Thus, post bracket 56 controls the height at which rigid shell back 36 is positioned on vertical post 52. Post bracket 56 is initially attached to the vertical post 52 by a hose clamp 54 as shown in FIG. 3A. The bracket can be moved up or down the post 52 to adjust the height of the rigid back shell 36. Post bracket 56 has hook means 60 in which rod 58 would rest. The hose clamp 54 is loosened, at screw 55, so that the rigid back shell 36 can be raised or lowered to determine the proper height for the patient. Once the proper height is determined, the position is marked with a pencil and the post bracket 56 and hose clamp 54 are removed from the vertical post 52. Two holes are drilled and tapped through the vertical post 52 of the wheelchair to mount the post brackets 56. The post bracket 56 is then placed back on the vertical post, and screws 57 are placed in each of these holes and screwed into place to hold the rigid back shell 36 steadfastly at that height.

Figure 3B:
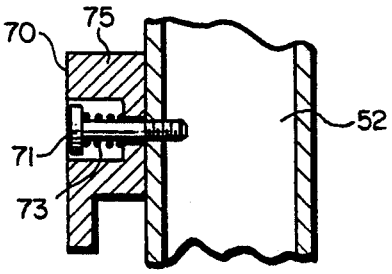
FIGS. 3B and 3C show the operation of the twist retainers of the mounting means.
Figure 3C:
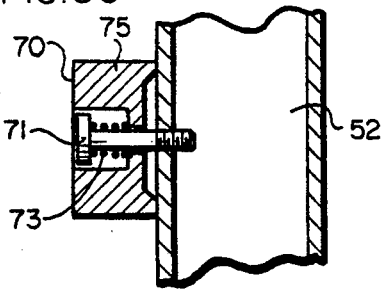

FIGS. 1–4 also show a U bracket 64 which is adjustably affixed to the rigid back shell 36. The U bracket is preferably made of steel. The U bracket 64 is adapted to curve partially around the front of vertical post 52 and is held temporarily in position by a hose clamp 66 and a hose clamp screw 68, as shown in FIG. 3A. When it is desired to mount the back system on the wheelchair, a twist retainer 70 is used to hold the U bracket 64 adjacent to vertical post 52, as shown in FIGS. 2 and 3. The temporary hose clamp 66 is then removed after twist retainer 70 is so mounted. Twist retainer 70 comprises a shoulder bolt 71, a spring 73, and a handle 75, and has a slit 72, as shown in FIG. 3B. FIG. 3C show top twist retainer 70 twisted 90° as it would be in the unlocked position. The twist retainer 70 is attached to the vertical post 52 by drilling through and tapping vertical post 52 and placing the shoulder bolt through the handle 75 and through spring 73 and into the vertical post 52. The slit 72 runs from the bottom of the twist retainer 70 to a point part way up the twist retainer 70. The U bracket 64 will fit into the slit 72 when the top twist retainer 70 is in the down and locked position, holding the U bracket 64 in place.

The means 50 for mounting the shell 36 to the vertical posts 52 constitute four separate points: two points consisting of rods 58 resting in the post brackets 56 and the two points consisting of U brackets 64 being held in place by twist retainers 70. It is to be understood that some wheelchairs may require that the lower two mounting points be placed on the rear of the vertical posts 52.

While the preferred embodiment has the post brackets 56 and rods 58 as the lower mounting points and the U brackets 64 and twist retainers 70 as the upper mounting points, it is to be understood that either type of mounting could be either the upper or lower mounting points.

The rigid back shell 36 can be moved forward or backwards to adjust seat depth D. This is done by changing the position of the U bracket 64 and changing the position of rod 58, i.e. loosening the top hex screw 74 on the U bracket 64 and by loosening the rod 58. The top hex screw 74 and the rod 58 are connected by a connection means 79. Preferably, the connection means 79 is a bar 79 on the inside of the forwardly extending flanges 38 of the rigid back shell 36 as shown in FIG. 1. As shown in FIG. 4, top hex screw 74 is held in place by nut 75 while rod 58 is held in place by nut 59. The nuts 59 and 75 are permanently affixed to bar 79 by welding or other suitable means. The rigid back shell 36 is then slid forward or backwards in slot 76 and groove 78. The back of rigid back shell 36 can be brought forward until it is substantially even with the vertical posts 52 of the wheelchair, as shown in FIG. 3 or pushed back until the front of the forwardly extending flanges 38 is substantially even with the vertical posts 52, as shown in FIG. 2. The groove 78 can have a number of teeth in it for which the hex screw would be located in. A preferred amount of teeth would be seven, however any number can be used. Accordingly, the seat depth D can be adjusted in any of seven different increments. It is to be understood that while the preferred invention uses teeth, however, any suitable mechanical arrangement could be used. For example, the teeth could be eliminated to provide infinite variation in seat depth D. The front surface of the padding system can be moved even further forward by placing one or more half-inch thin foam shims between the adjustable rigid back shell and the padding system.

The rigid back shell 36 can also be tilted, as shown by arrow A in FIG. 1, by sliding either the top hex screw 74 or the rod 58 farther forward (or backwards) of each other. Once the desired position is reached, top hex screw 74 and rod 58 are tightened in nuts 75 and 59, respectively, to hold that particular position steadfastly.

The above fully describes the adjustment of the shell as to height H, depth D, and angle A for a preferred embodiment. These adjustments are generally made by a trained therapist or other suitable field person such as a dealer. It should be noted that these adjustments can be made without removing any part of the assembly from the wheelchair or removing the padding system components from the rigid back.

One embodiment of the padding system for the modular back system of the present invention comprises a pre-molded foam insert for the users who do not require an extensively customized fit. For example, this embodiment could be used by a person with a spinal cord injury or a person with a recent traumatic brain injury. FIGS. 5A–5D show this embodiment. The pre-molded foam version comprises a contoured foam pad 100 which is attached to a rigid back shell 36 at the VELCRO strip(s) 103. Mounting means are used to removably affix the rigid back shell 36 to the wheelchair in a selected position and attitude as previously discussed.

The contoured foam pad 100 has a symmetrical, contoured shape. A fluid pad member 102 runs down the middle of the contoured foam pad 100 and is generally sized so that it will overlie the spinal region of the user. However, the fluid pad member 102 can be sized to lower the entire back region. On the back side of the fluid pad member 102 are VELCRO strips which attach to VELCRO strips 101 on the contoured foam pad 100. If build-up pads 22 are used, fluid pad member 102 will overlie the front surface of the padding system, including any build-up pads 22.

The fluid pad member 102 is an envelope of plastic film that preferably is flexible at the ambient room temperatures of use, readily stretchable with fairly light pressure to avoid the hammocking problem described previously, and of a suitable thickness to avoid accidental punctures. The envelope contains the flowable fluid material. The fluid is a highly viscous liquid, i.e., plastic or viscous thixotropic material, which flows gradually when pressure is applied to it, but which maintains its shape and position in absence of pressure. One such viscous fluid is commercially available under the trade name "FLOLITE", the registered mark of Alden Laboratories. Suitable flowable materials are described and claimed in the U.S. patents below, which are incorporated by reference herein:

U.S. Pat. No. 3,237,319
U.S. Pat. No. 3,402,411
U.S. Pat. No. 3,635,849
U.S. Pat. No. 3,798,799
U.S. Pat. No. 4,038,762

U.S. Pat. No. 4,083,127
U.S. Pat. No. 4,108,928
U.S. Pat. No. 4,144,658
U.S. Pat. No. 4,229,546
U.S. Pat. No. 4,243,754
U.S. Pat. No. 4,255,202
U.S. Pat. No. 4,728,551

The bony prominences of the spine will nestle into the pad member where needed to protect the prominences from injury caused by being in contact with the back of the wheelchair.

Adjustable lumbar supports 104 can be attached to the contoured foam pad 100 underneath the fluid pad member 102. By using a lumbar support, this embodiment can be somewhat customized to support the user. Additionally, foam lateral supports 106 can be attached to the contoured foam pad 100 at any location to further customize this embodiment. A cover can be placed over the contoured foam pad to hold the components in place as will be described later.

The second embodiment of the padding system used in the modular back system of the present invention is shown in FIGS. 6–12. In the preferred embodiment, as shown in FIG. 6, a thin shim 18 is affixed to a rigid back shell 36. Preferably, the shim 18 is made of foam in order to provide minimum weight, but other materials may be used. The shim may be attached to the rigid back shell 36 by any means, but VELCRO 34 is generally preferred.

Figure 6A:
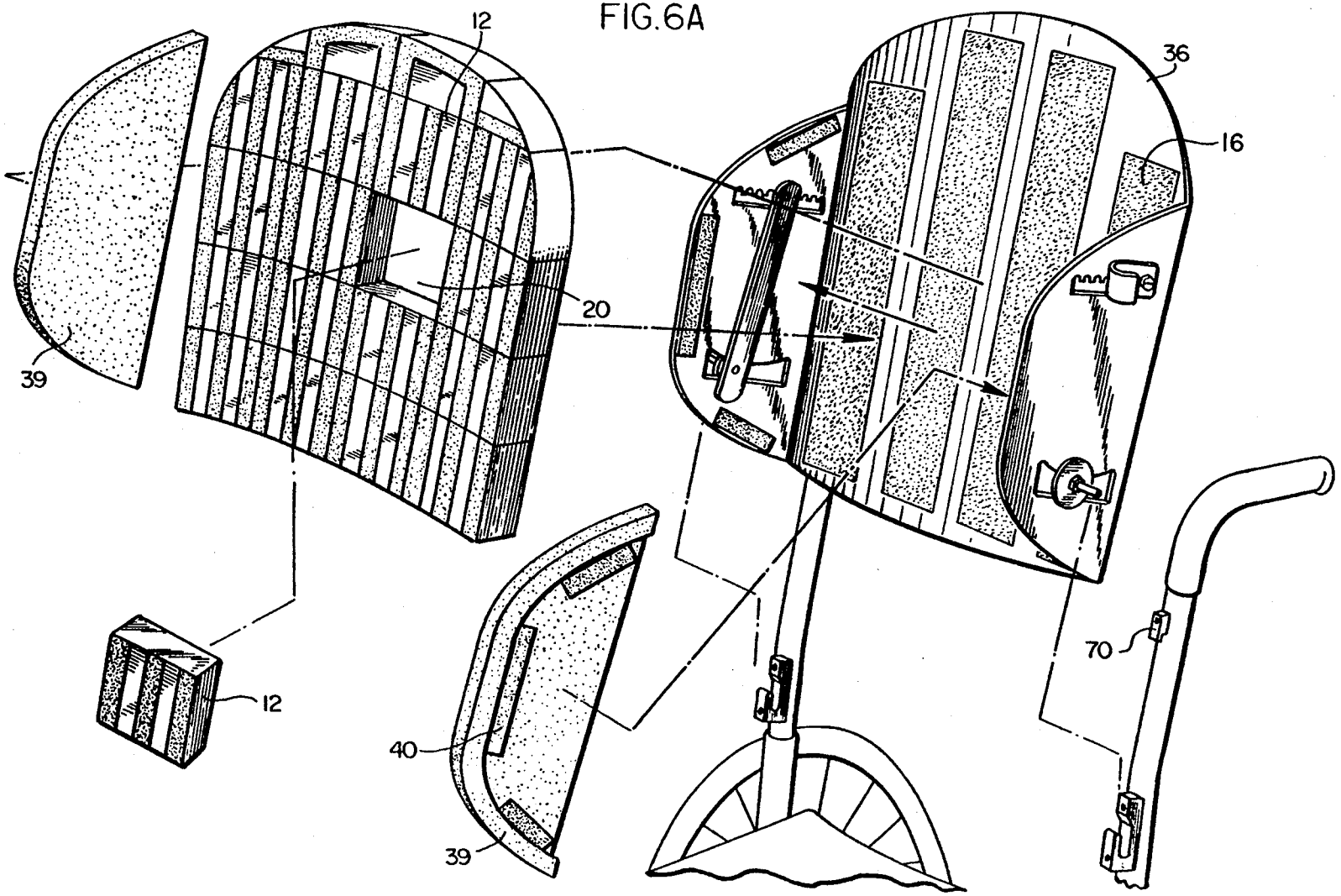
FIG. 6A is a view similar to FIG. 6 showing another embodiment with the thin shim removed.

A plurality of foam blocks 12 are removably affixed to the shim 18, preferably by VELCRO attachment 16. The blocks provide a substantially continuous layer of foam over the surface of the shim 18 and positioned forward of the front surface of the rigid back shell 36. Preferably, the blocks are all the same depth so that the blocks provide a substantially uniform depth of foam over the front surface of the shim. If a shim is not used, the blocks 12 may be affixed to the rigid back shell 36 also by VELCRO attachments of strips 16 as shown in FIG. 6A. Whether or not the shim 18 is used, the foam blocks 12 provide a substantially continuous layer of substantially uniform depth positioned forward of the front surface of the rigid back shell 36.

It is generally desired that the shim 18 and/or the rigid back shell 36 be curved in the manner to provide a contouring which approximates a contour of the back of the user. Thus, when the blocks 12 are in place on shim 18, they provide a substantially continuous surface which is somewhat contoured to fit a human back.

However, it is to be understood that the forward facing front face of the shell 36 could be any shape (such as flat) and that the contour shape required for the back of a user could be obtained by properly varying the depth of the blocks 12 so as to achieve a contour on the front surface thereof.

FIG. 6 shows the removable foam blocks 12 which are included within the second embodiment of the padding system. The foam blocks are preferably made of EVA, polyethylene or polyurethane, but other foam materials may be used. The foam blocks 12 are typically $3\frac{1}{2}'' \times 3\frac{1}{2}'' \times 2''$ to $4''$ in depth. All of the foam blocks 12 are initially attached by VELCRO strips located on the back of the foam blocks to VELCRO strips 16 located on a thin shim 18 so as to form a substantially continuous layer of foam of substantially uniform depth over the front surface of the thin foam shim. The foam blocks 12 can be removed individually or in groups from the thin foam shim 18 to produce a recessed area 20. Replacement of the blocks is facilitated by color coding the VELCRO strips on the front and back of the blocks and on the front of the shim. The recessed area 20 provides a customized fit to the wheelchair user's back. By recessing any protrusions from the user's back by removal of selected foam blocks, contact between the protrusion and the wheelchair back is reduced and contact between the rest of the user's back and the wheelchair back is increased. The foam blocks 12 are all beveled so that there will be no sharp edges to cause discomfort for the user.

Figure 7:
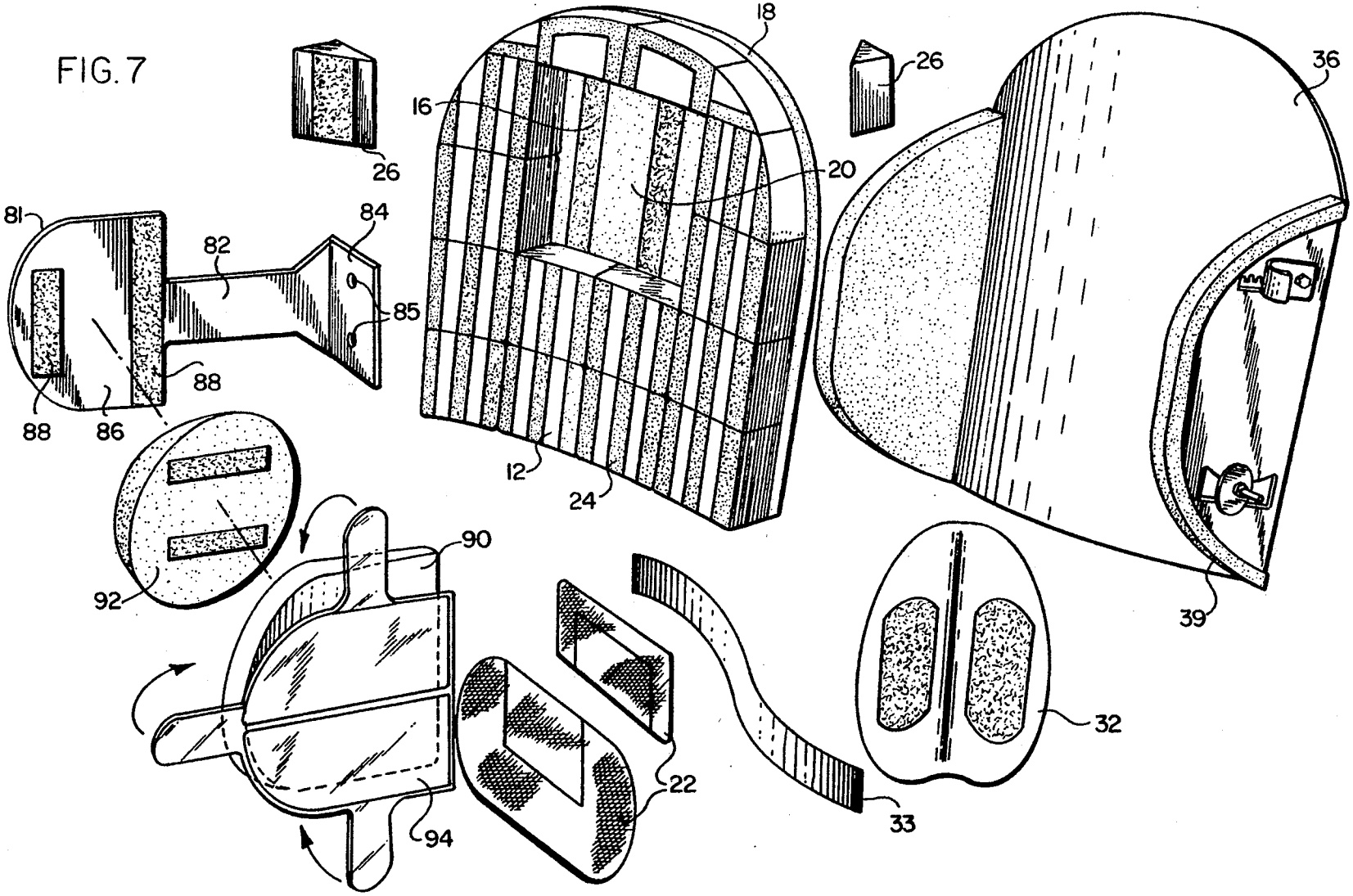
FIG. 7 shows some of the possible components of a second embodiment of the padding system.
Figure 8:
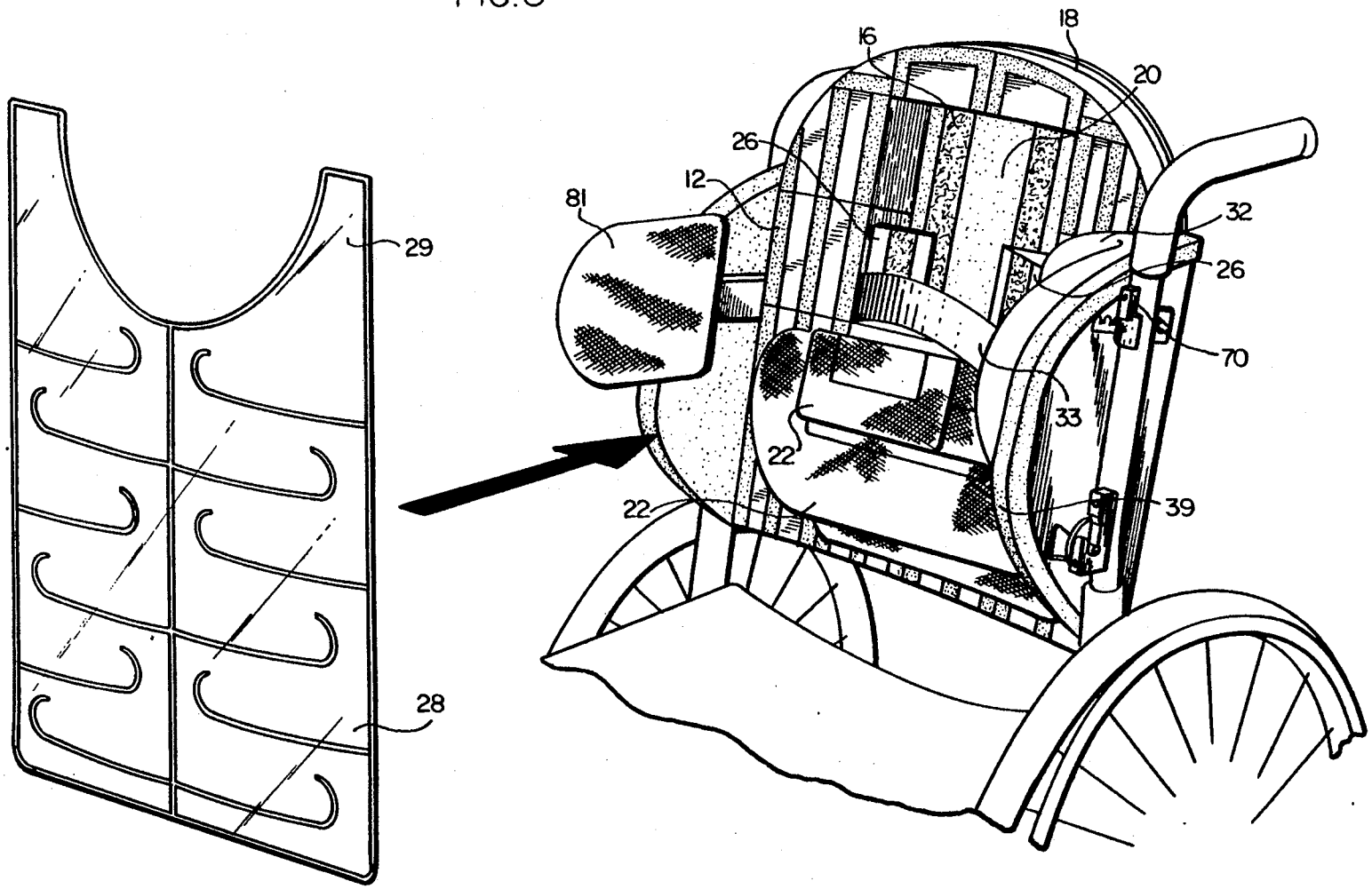
FIG. 8 shows the pad member being placed over the padding system of the second embodiment of the padding system.

To smooth off the transition between the recessed area 20 and the foam blocks 12 and to better support the back of the user, transition members or wedges 26, can be used, as shown in FIGS. 7 and 8. The transition wedges 26 prevent any drastic drop offs or ledges between the recessed area 20 and the foam blocks 12. The wedges 26 can be of any size or geometric shape. However, in a preferred embodiment, two sizes of a triangular shape are available, a full size which extends as long as the foam block and is as high as the foam block at its highest point, and a version half this size. The transition wedges 26 have a VELCRO strip (not shown) on the back of wedge 26 that will attach to the VELCRO strip 16 located on the thin foam shim 18 or surface of the shell 36.

Frequently, an area in front of the foam blocks 12 has to be built up to conform to the user's body. FIGS. 7 and 8 show build-up pads 22 of various geometric shapes and thicknesses being used to build up the area in front of the foam blocks 12. Build-up pads may be used for other padding systems, wherein they are affixed to the front side of a contoured foam back pad to provide customization, as required. The build-up pads are made in the preferred embodiment of "display cloth" and are filled with plastic beads. A strip of VELCRO is affixed to the back of the pad. In another embodiment, the build-up pads are made of fabric, foam, and/or various other materials. The build-up pads 22 are attached to the VELCRO strips 24 located on the front of the foam blocks 12. The build-up pads 22 may be fabricated in various sizes and thicknesses. In addition, the build-up pads 22 can be placed in the recessed area 20 to build that area up when the full four inches of recessed depth is not needed and are attached to strips 16.

To provide lateral support for the user, adjustable lateral supports 32 can be utilized. These adjustable lateral supports 32 have VELCRO (not shown) on the bottom of the support which sticks to the VELCRO strips 24 on the front of the foam blocks 12. For those users who lean heavily against the adjustable lateral supports 32, causing the supports to loosen or deform, a VELCRO suspender 33 can be used. One end of the suspender 33 is attached by VELCRO to the front of the adjustable lateral support 32 and the other end is attached to the VELCRO strip 24 on the front of the foam blocks 12. This should secure the adjustable lateral support 32, especially when the user's body weight leans against the lateral support and the suspender.

Figure 9:
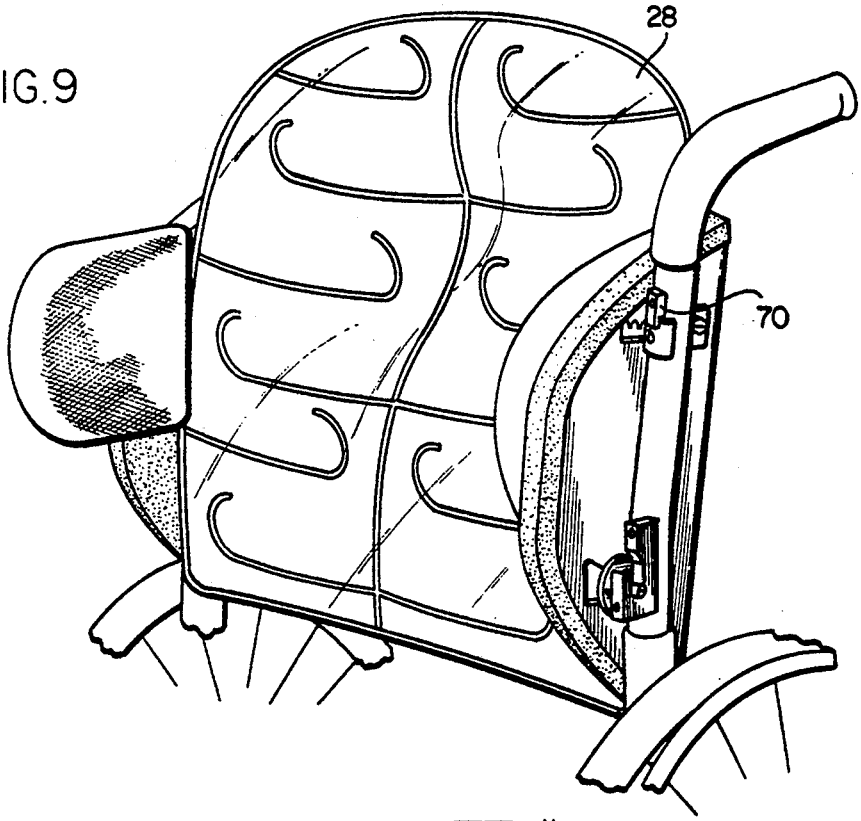
FIG. 9 shows the pad member in place.

Approximately 80 to 90 percent of the conformity to the user's body is achieved by using the combination of foam blocks, transition wedges, and build-up pads. This should provide conformity from about $\frac{1}{4}$ inch to $\frac{1}{2}$ inch from the user's back. The final 10 to 20 percent of conformity to the user's body, to provide the substantially perfect fit, is achieved by using a pad member. The preferred embodiment of the pad member comprises an envelope containing a flowable fluid material. FIG. 9 shows the pad member 28 in place. As shown in FIG. 8, the pad member 28 is attached to the thin foam shim 18, the transition wedges 26, foam lateral supports 32 and the foam blocks 12 by the use of VELCRO. Normally, it will cover the build-up pads without attaching to them. The pad member is comprised of the same material as described in the first embodiment of the padding system.

One side of the pad member has an opaque cover. The other side of the back may be clear or transparent. This allows the therapist or trained fitter to determine if there is any bottoming out by the user. The user will lean against the deformity back system including against the pad member. After several minutes, the user will be leaned forward in the chair and the pad member will be leaned forward. If there has been a bottoming out, the opaque front cover will be able to be seen through the clear back. The therapist or fitter can then make adjustments to prevent this bottoming out.

The pad member 28 will typically have flaps 29 at the top of the pad which wrap over the top of the thin shim 18. The thin shim 18 has VELCRO strips on its back which attach to the VELCRO strips on the flaps 29 of the pad member 28, helping to hold the pad member 28 in place.

The pad member 28 is positioned over the front surface of the foam blocks 12 and covers the whole final shape of the user's back. It is oversized by a significant amount so that it can be draped or received into the recesses 20 in the foam block layer 12 and removably attached by the VELCRO strips 16 to the shim 18 in the embodiment of FIG. 6 or to the rigid back shell 36 in the embodiment of FIG. 6A. It also can easily fill in over the build-ups from the build-up pads while overlying the surface of the thin shim. The pad member will also smooth out the edges of all the components (i.e. foam blocks, foam lateral supports, build-up pads, transition wedges) underneath it.

Figure 12:
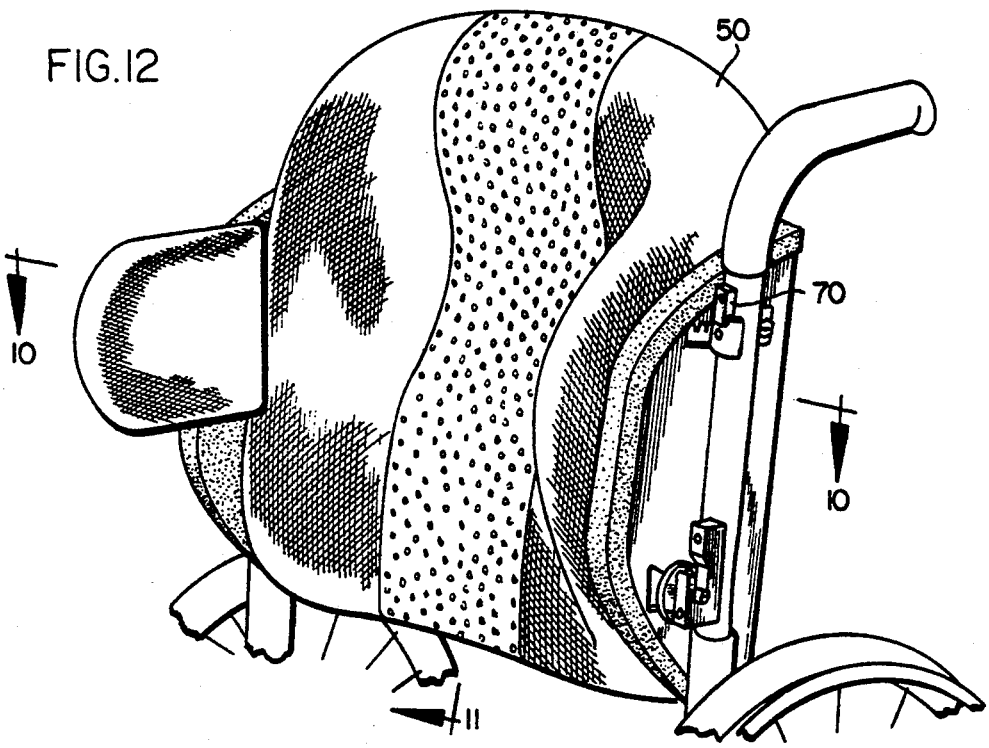
FIG. 12 shows a cover over the padding system of the second embodiment.
Figure 10:
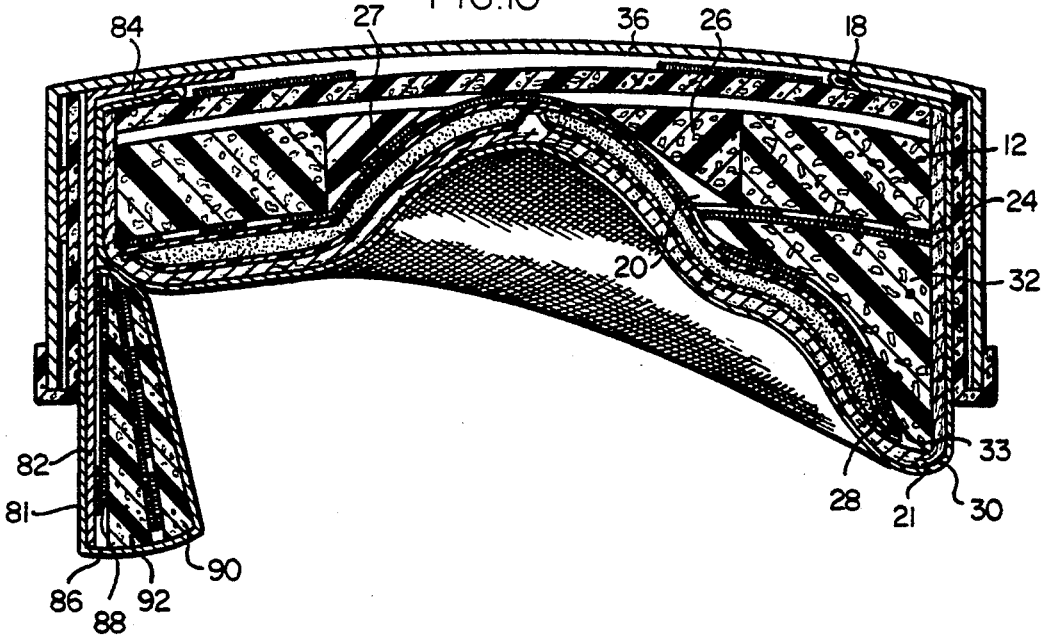
FIGS. 10 and 11 show cross-sectional views of the padding system of the second embodiment.
Figure 11:
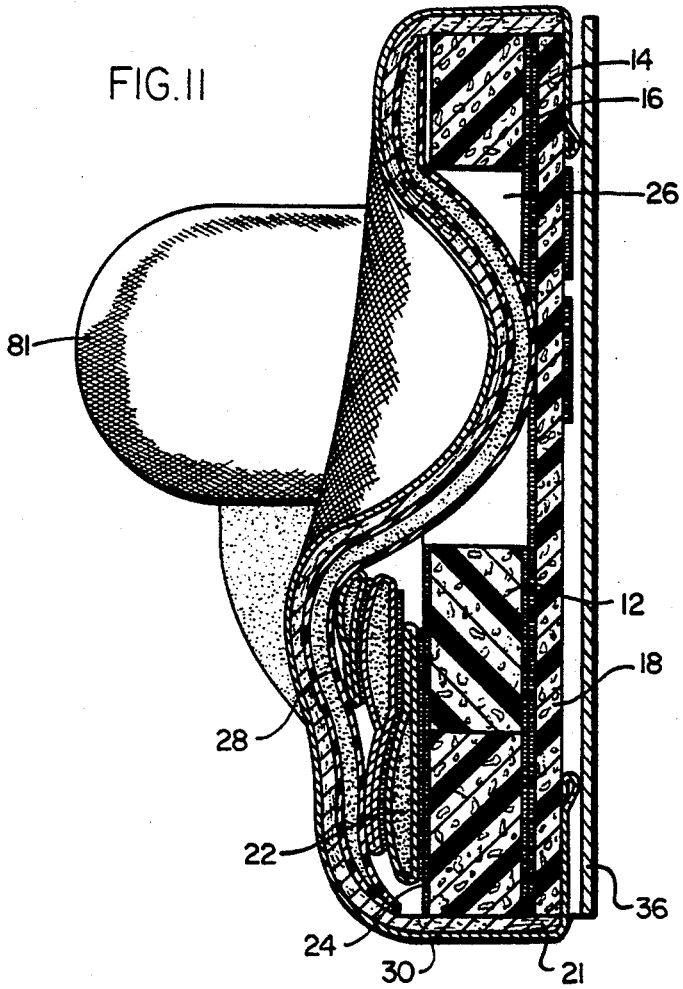

FIGS. 10 and 11 show a cross-sectional view of the second embodiment of the padding system of the modular back system. The second embodiment shown in FIG. 10 comprises the thin shim 18, the foam blocks 12, the transition wedges 26, the pad member 28, the adjustable lateral support 32, the VELCRO suspender 33, a cover 30 and the rigid back shell 36. FIG. 11 shows the second embodiment with the addition of the build-up pads 22. The thin shim 18 has VELCRO strips 16. The foam blocks 12 have a VELCRO strip 14 on the back of each block which attaches to the VELCRO strips 16 on the thin shim 18. The foam blocks 12 have a VELCRO strip 24 in the front of each block to which the pad member 28 is attached in FIG. 10 and which the build-up pads 22 are attached in FIG. 11. The transition wedges 26 have a VELCRO strip on the back of the wedge and a VELCRO strip 27 on the front of the transition wedge. The pad member 28 can also be attached to the VELCRO strips 16 of the thin shim 18, which are located in the recessed area 20 and the VELCRO strips 27 on the front of the transition wedges 26. All the components are then covered by a cover 30, as shown in FIG. 12.

Any type of cover can be used to enclose and protect the internal components. Preferably, the cover is a breathable, air exchange cover. This cover is adapted to maintain the pad member in its position with respect to the thin shim and foam blocks. The inside of the cover can be made of a reticulated foam 21 which draws fresh air when the user moves which decreases heat and moisture build-up. This cover is also more comfortable than the vinyl covers presently used in wheelchair backs. Further, it is easy to wash and is a fitted cover which fits over the system. Another preferred cover is one employing an inside protective cover and an outside washable cover.

The thin shim 18 preferably has VELCRO strips (not shown) on the back of the shim to removably attach to the VELCRO strips 34 of the rigid back shell 36, as shown in FIG. 6. In the preferred embodiment, the shim is foam, but it may be made from any suitable material. Accordingly, the thin shim 18 and components attached to it (i.e., foam blocks, transition wedges, build-up pads, and pad member) can be easily detached from the rigid back shell and removed from the wheelchair. The rigid back shell 36 has foam side guards 39 on each side to protect the user from being scratched or injured by the mounting means 50.

For a patient who needs more width or deeper lateral support than can be provided by the adjustable lateral supports, an external lateral support 81 can be used as shown in FIG. 8. The external lateral support can be used with the first embodiment of a single contour padding system or with the second embodiment of a padding system with removable blocks. As shown in FIG. 7, the external lateral support 81 comprises an extended lateral bracket 82 which is preferably made of metal. The attachment end 84 of extended lateral bracket 82 is curved at a right angle so that the attachment end 84 can fit between the thin shim 18 and the rigid back shell 36. A VELCRO strip is located on the attachment end 84 of the extended lateral bracket 82 to be used for assessment purposes. During assessment, the extended lateral bracket 82 can be moved up or down until the proper height for the user is determined. The attachment end 8.4 then has two holes 85 for screws in order to permanently attach the extended lateral bracket 82 to the rigid back shell 36.

The support end 86 of extended lateral bracket 82 is shaped like a paddle and has two strips 88 of VELCRO on it. A contoured foam pad 90 can be stuck on the VELCRO strips 88 to protect the user from being injured by the metal bracket. It also may be necessary to place a lateral wedge 92 between the support end 88 and the contoured foam pad 90 to tilt the contoured pads surface. The lateral wedge 92 is round and has a very narrow edge on one edge which widens out to half inch or more thick wedge at the other end. The lateral wedge 92 can be rotated to provide a tilt at any selected angle. The lateral wedge 92 has VELCRO strips on both sides that will allow the wedge 92 to be attached to the support end 86 of the bracket and to the contoured foam pad 90. In a further embodiment, two wedges 92 can be oppositely fastened together. The two attached wedges would then be attached to the support end 86 of the bracket and the contoured foam pad 90.

A lining fluid pad 94 made out of the same plastic film and flowable fluid material as the fluid pad 102, can be wrapped around the contoured foam pad 90 to protect the patient from skin breakdowns caused by rubbing against the contoured foam pad. The lining fluid pad 94 has three flaps that wrap around the pad and attach by VELCRO to the support end 88 of the extended lateral bracket 82. The lining fluid pad 94 can be of special help to those users who have bony rib cages or who move around a lot. A cover can be placed over the lining fluid pad. The cover will enclose the whole support end 82 of the extended lateral support 81 in order to keep it all together and in place, to keep it from getting dirty, and to add to the cosmetic look of the wheelchair.

The forms of invention shown and described herein are to be considered only as illustrative. It would apparent to those skilled in the art that numerous modifications may be made therein without departing from the spirit of the invention or the scope of the appended claims.

What is claimed:

1. A wheelchair back system adapted to support the back of a human, said system being adapted to provide customized fit to a wheelchair user, said system comprising:

a rigid back shell;

mounting means to removably affix said rigid back shell to a wheelchair;

a plurality of foam blocks, said back shell having a front surface and said system further including means for removably attaching said foam blocks to the front surface of said back shell, said foam blocks further having a front surface and providing a substantially continuous layer of foam of substantially uniform depth over the front surface of said back shell, said foam blocks being individually and separately removable from said back shell to provide a recessed area in said substantially continuous layer of foam to provide customized fit to wheelchair users; and a pad member being sized to overlie the front surface of said foam blocks, said system further including means for attaching said pad member to the front surface of said foam blocks and to the front surface of said rigid back shell in any recessed area formed by the removal of a block.

2. The back system as described in claim 1 having a transition wedge placed in a recessed area formed by the removal of a foam block, said transition wedge providing a sloped surface between the front surface of said rigid back shell in said recessed area and the front surface of an adjacent foam block.

3. The back system as described in claim 1 having a build-up pad and means for attaching said build-up pad to the front surface of a foam block, said build-up pad providing a more customized conformity with the back.

4. The back system as described in claim 1 having at least one adjustable lateral support and means for attaching said lateral support to the front surface of said foam blocks.

5. The back system as described in claim 1 wherein said pad member comprises an envelope containing a flowable fluid material.

6. A wheelchair back system adapted to support the back of a human, said system being adapted to provide customized fit to a wheelchair user, said system comprising:

a rigid back shell;

mounting means to removably affix said rigid back shell to a wheelchair;

a plurality of foam blocks and a thin shim interposed between said rigid shell and said foam blocks, said thin shim having a front surface and said system further including means for removably attaching said foam blocks to the front surface of said thin shim, said foam blocks providing a substantially continuous layer of foam of substantially uniform depth over the front surface of said thin shim, said foam blocks being individually and separately removable from said thin shim to provide a recessed area in said substantially continuous layer of foam to provide customized fit to wheelchair users; and a pad member being sized to overlie the front surface of said foam blocks, said system further including means for attaching said pad member to the front surface of said foam blocks and to the front surface of said thin shim in any recessed area formed by the removal of a block.

7. The back system as described in claim 6 having a cover, said cover enclosing said thin shim, said foam blocks and said pad member, said cover adapted to maintain said pad in its position with respect to said thin shim and said foam blocks.

8. The back system as described in claim 6 having a transition wedge placed in a recessed area formed by the removal of a foam block, said transition wedge providing a sloped surface between the front surface of said thin shim in said recessed area and the front surface of an adjacent foam block.

9. The back system as described in claim 6 having a build-up pad and means for attaching said build-up pad to the front surface of a foam block, said build-up pad providing a more customized conformity with the back.

10. The back system as described in claim 6 having at least one adjustable lateral support and means for attaching said lateral support to the front surface of said foam blocks.

11. The back system as described in claim 6 wherein said pad member comprises an envelope containing a flowable fluid material.

12. A wheelchair back system adapted to support the back of a human, said system being adapted to provide customized fit to a wheelchair user, said system comprising:

a rigid back shell having lateral edges and a pair of flanges extending forwardly from the lateral edges;

mounting means affixed to said flanges to removably affix said rigid back shell to a wheelchair;

a plurality of foam blocks, said back shell having a front surface and said system further including means for removably attaching said foam blocks to the front surface of said back shell, said foam blocks further having a front surface and providing a substantially continuous layer of foam of substantially uniform depth over the front surface of said rigid back shell, said foam blocks being individually and separately removable from said rigid back shell to provide a recessed area in said substantially continuous layer of foam to provide customized fit to wheelchair users; and a pad member comprising an envelope containing a flowable fluid being sized to overlie the front surface of said foam blocks, said system further including means for attaching said fluid pad to the front surface of said foam blocks and to said back shell in any recessed area formed by the removal of a block.

13. The back system as described in claim 12 having a transition wedge placed in a recessed area formed by the removal of a foam block, said transition wedge providing a sloped surface between the front surface of said rigid back shell in said the recessed area and the front surface of an adjacent foam block.

14. The back system as described in claim 12 having a build-up pad and means for attaching said build-up pad to the front surface of a foam block, said build-up pad providing a more customized conformity with the back.

15. The back system as described in claim 12 having at least one adjustable lateral support and means for attaching said lateral support to the front surface of said foam blocks.

16. The back system as described in claim 15 having a suspender and means for attaching said suspender to said adjustable lateral support and said foam blocks to hold said adjustable lateral support secure.

17. The back system as described in claim 12 wherein said pad member comprises an envelope filled with a flowable fluid material.

18. The back system as described in claim 17 wherein one side of said pad member is transparent.

19. The back system as described in claim 12 having an external lateral support and means for movably adjusting said external lateral support up and down relative to said rigid back shell to find a preferred position for the human.

20. The back system as described in claim 19 wherein said external lateral support comprises an extended lateral bracket and a contoured pad.

21. The back system as described in claim 20 further including means for removably attaching said extended lateral bracket to said rigid back shell.

22. The back system as described in claim 19 wherein said external lateral support is permanently affixed to the rigid back shell by a plurality of screws which are placed through a plurality of holes in said extended lateral bracket and into said shell.

23. The back system as described in claim 19 further including a contoured pad wherein said external lateral support has at least one lateral wedge and means for attaching said lateral wedge between the said external lateral support and said contoured pad.

24. The back system as described in claim 19 further including a contoured pad wherein said contoured pad and said external lateral support are covered by a lining fluid pad comprising a flowable fluid material.

25. A wheelchair back system adapted to support the back of a human, said system being adapted to provide customized fit to a wheelchair user, said system comprising:

a rigid back shell-having lateral edges and a pair of flanges extending forwardly from the lateral edges;

mounting means affixed to said flanges to removably affix said rigid back shell to a wheelchair;

a plurality of foam blocks and a thin shim interposed between said rigid back shell and said foam blocks, said thin shim having a front surface and said system further including means for removably attaching said foam blocks to the front surface of said thin shim, said foam blocks providing a substantially continuous layer of foam of substantially uniform depth over the front surface of said thin shim, said foam blocks being individually and separately removable from said thin shim to provide a recessed area in said substantially continuous layer of foam to provide customized to wheelchair users; and a pad member comprising an envelope containing a flowable fluid being sized to overlie the front surface of said thin shim, said system further including means for attaching said fluid pad to the front surface of said foam blocks and to said thin shim in any recessed area formed by the removal of a block.

26. The back system as described in claim 25 having a cover enclosing said thin shim, said foam blocks and said pad member, said cover adapted to maintain said pad member in its position with respect to said thin shim and said foam blocks.

27. A wheelchair back system adapted to support the back of a human, said system being adapted to provide customized fit to a wheelchair user, said system comprising:

a rigid back shell;

means for mounting said rigid back shell to a wheelchair;

a plurality of foam blocks, said back shell having a front surface facing forward and said system further including means for removably positioning said foam blocks forward of the front surface of said back shell, said foam blocks further having a front surface and providing a substantially continuous layer of foam forward of the front surface of said back shell, said foam blocks being individually and separately removable to provide a recessed area in said substantially continuous layer of foam to provide customized fit to the wheelchair user; and a pad member sized to overlie the front surface of said foam blocks between the wheelchair user and the foam blocks and forward of the rigid back shell with a portion of the pad member assuming a position extending and received in any recessed area formed by the removal of a block, said system further including means for retaining said portion of said pad member in said position extending and received in said recessed area forward of said rigid back shell and between the wheelchair user and the rigid back shell.

28. The wheelchair back system as described in claim 27 wherein a thin shim is interposed between said rigid back shell and said foam blocks.

29. The back system as described in claim 28 having a cover, said cover enclosing said thin shim, said foam blocks, and said pad member.

30. The back system as described in claim 28 further including means for removably attaching said thin shim to said rigid back shell.

31. The back system as described in claim 26 wherein said thin shim has a front surface and said retaining means includes means for attaching said pad member to the front surface of said thin shim in any recessed area formed by the removal of a block.

32. The back system as described in claim 27 having a transition member placed at least in part in a recessed area formed by the removal of a foam block.

33. The back system as described in claim 32 wherein said transition member is a transition wedge having a sloped surface.

34. The back system as described in claim 27 having a build-up pad and means for attaching said build-up pad to the front surface of a foam block.

35. The back system as described in claim 27 having at least one adjustable lateral support attached to the front surface of said foam blocks.

36. The back system as described in claim 35 having a suspender and means for attaching said suspender to said adjustable lateral support and said foam blocks to hold said adjustable lateral support secure.

37. The back system as described in claim 27 wherein said pad member comprises an envelope containing a flowable fluid material.

38. The back system as described in claim 39 wherein said fluid material is a highly viscous liquid.

39. The back system as described in claim 27 having an external lateral support and means for movably adjusting said external lateral support up and down relative to said rigid back shell to find a preferred position for the human.

40. The back system as described in claim 39 wherein said external lateral support comprises an extended lateral bracket and a contoured pad.

41. The back system as described in claim 39 further including a contoured pad wherein said external lateral support has at least one lateral wedge and means for attaching said lateral wedge between the said external lateral support and said contoured pad.

42. The back system as described in claim 39 further including a contoured pad wherein said contoured pad and said external lateral support are covered by a lining fluid pad comprising a flowable fluid material.

43. The back system as described in claim 27 wherein said retaining means includes means for attaching said pad member to the front surface of said rigid back shell in any recessed area formed by the removal of a block.

44. A wheelchair back system adapted to support the back of a human, said system being adapted to provide customized fit to a wheelchair user, said system comprising:

a rigid back shell;

means for mounting said rigid back shell to a wheelchair;

a plurality of foam blocks, said back shell having a front surface facing forward and said system further including means for removably positioning said foam blocks forward of the front surface of said back shell, said foam blocks further having a front surface and providing a substantially continuous layer of said back shell, said foam blocks being individually and separately removable to provide a recessed area in said substantially continuous layer of foam to provide customized fit to wheelchair users; and a pad member sized to overlie the front surface of said foam blocks wherein a thin shim is interposed between said rigid back shell and said foam blocks, said thin shim having a front surface and said system further including means for attaching said pad member to the front surface of said thin shim in any recessed area formed by the removal of a block.

45. A wheelchair back system adapted to support the back of a human, said system being adapted to provide customized fit to a wheelchair user, said system comprising:

a rigid back shell;

means for mounting said rigid back shell to a wheelchair;

a plurality of foam blocks, said back shell having a front surface facing forward and said system further including means for removably positioning said foam blocks forward of the front surface of said back shell, said foam blocks further having a front surface and providing a substantially continuous layer of foam of substantially uniform depth forward of the front surface of said back shell, said foam blocks being individually and separately removable to provide a recessed area in said substantially continuous layer of foam to provide customized fit to wheelchair users; and a pad member sized to overlie the front surface of said foam blocks wherein said system further includes means for attaching said pad member to the front surface of said rigid back shell in any recessed area formed by the removal of a block.

* * * * *